US010267155B2

(12) United States Patent
Montes Parra

(10) Patent No.: US 10,267,155 B2
(45) Date of Patent: Apr. 23, 2019

(54) METHOD FOR INTENTIONALLY MISTUNING A TURBINE BLADE OF A TURBOMACHINE

(71) Applicant: SAFRAN AIRCRAFT ENGINES, Paris (FR)

(72) Inventor: Roger Felipe Montes Parra, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 15/772,011

(22) PCT Filed: Oct. 28, 2016

(86) PCT No.: PCT/FR2016/052819
§ 371 (c)(1),
(2) Date: Apr. 27, 2018

(87) PCT Pub. No.: WO2017/072469
PCT Pub. Date: May 4, 2017

(65) Prior Publication Data

US 2018/0313216 A1 Nov. 1, 2018

(30) Foreign Application Priority Data

Oct. 28, 2015 (FR) ..... 15 60326

(51) Int. Cl.
*F01D 5/10* (2006.01)

(52) U.S. Cl.
CPC ..... *F01D 5/10* (2013.01); *F05D 2220/32* (2013.01); *F05D 2260/96* (2013.01)

(58) Field of Classification Search
CPC ..... F01D 5/10; F01D 5/16; F01D 5/26; F01D 25/04; F01D 25/06; F01D 5/027; Y10S 416/50
USPC ..... 415/119
See application file for complete search history.

(56) References Cited

U.S. PATENT DOCUMENTS

2015/0198047 A1 7/2015 Roche
2015/0292337 A1* 10/2015 Gentile ..... F01D 5/26 416/223 R

FOREIGN PATENT DOCUMENTS

EP 2463481 A2 6/2012
EP 2896791 A1 7/2015
FR 2869069 A1 10/2005

OTHER PUBLICATIONS

Salvat et al., "Caractéristiques modales des mouvements d'arbre pour des structures à symétrie cyclique", Modal characteristics of shaft movements for cyclic symmetry structures, <hal-00881272v2>, 2013, pp. 1-8. (Partial Abstract).

(Continued)

*Primary Examiner* — Justin D Seabe
*Assistant Examiner* — Jason Mikus
(74) *Attorney, Agent, or Firm* — Womble Bond Dickinson (US) LLP

(57) ABSTRACT

The present invention relates to a method (100) for intentionally mistuning a turbine blade of a turbomachine (10), by providing raised portions (31) or slots (32), the position of which is calculated on the basis of a vibration analysis of the disk (steps a) to d)).

8 Claims, 15 Drawing Sheets

(56) References Cited

OTHER PUBLICATIONS

Figure 1:
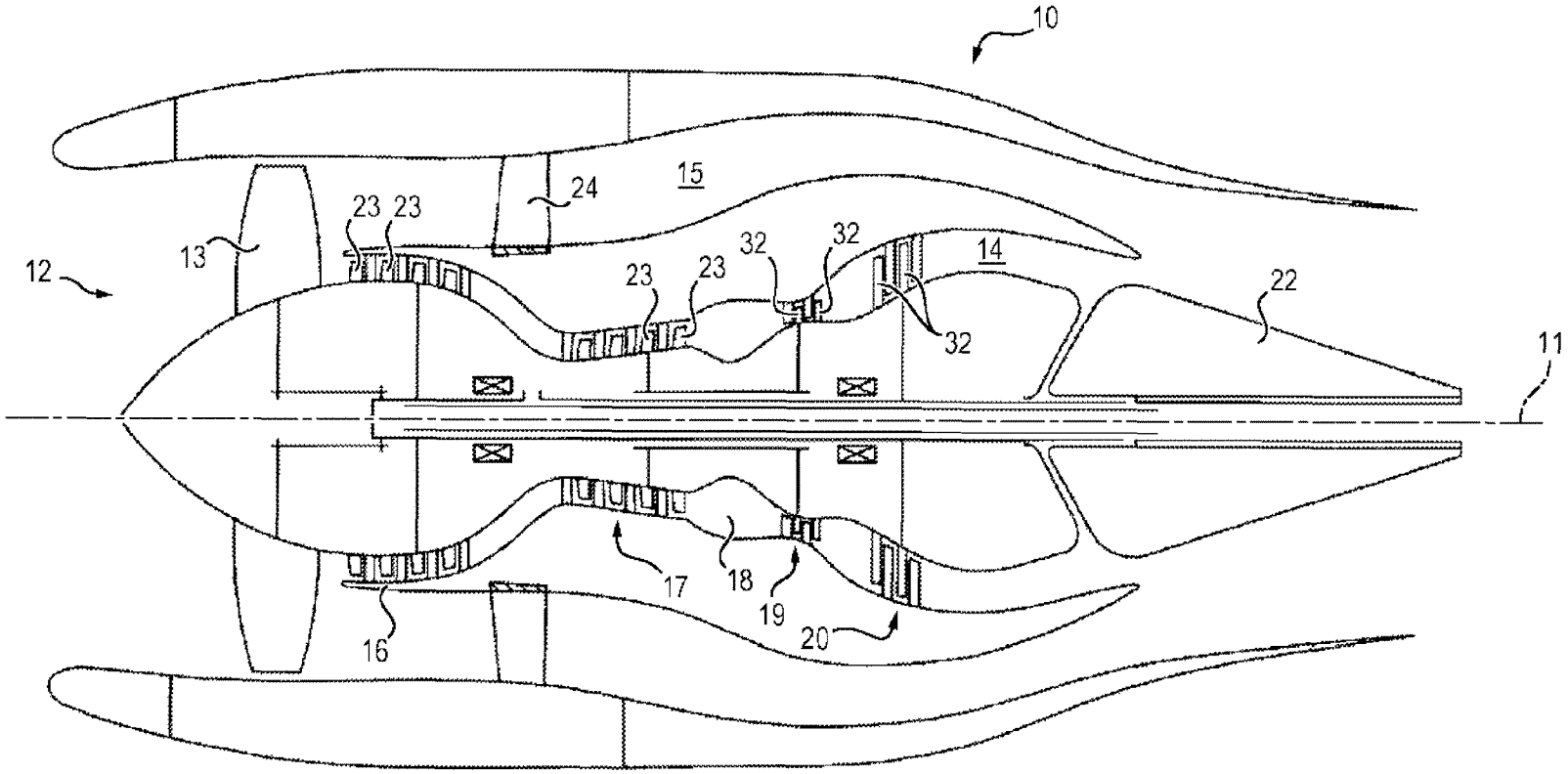

Marion Gruin, "Dynamique non-linéaire d'une roue de turbine Basse Pression soumise à des excitations structurales d'un turboréacteur", Non-linear dynamics of a low-pressure bladed wheel subject to structural excitations of a turbojet, Ecole Centrale de Lyon, 2012. French. <NNT: 2012ECDL0003>. <tel-00750011 >, 218 pages. (English Abstract submitted).

International Search Report and Written Opinion received for PCT Patent Application No. PCT/FR2016/052819, dated Feb. 6, 2017, 16 pages (7 pages of English Translation and 9 pages of Original Document).

International Preliminary Report on Patentability received for PCT Patent Application No. PCT/FR2016/052819, dated May 11, 2018, 13 pages (7 pages of English Translation and 6 pages of Original Document).

Denis Laxalde, "Étude d'amortisseurs non-linéaires appliqués aux roues aubagées et aux systèmes multi-étages", Study on non-linear shock absorbers applied to bladed wheels and multi-stage systems, Mechanics. Ecole Centrale de Lyon, 2007, French. <tel-00344168>, 198 pages. (English Abstract submitted).

Bartolomé Segui Vasquez, "Modélisation dynamique des systèmes disque aubes multi-étages : Effets des incertitudes", Dynamic modelling of multi-stages blade disc systems: Uncertainty effects, INSA de Lyon, 2013. Français. <NNT : 2013ISAL0057>. <tel-00961270>, 150 pages. (English Abstract submitted).

* cited by examiner

METHOD FOR INTENTIONALLY MISTUNING A TURBINE BLADE OF A TURBOMACHINE

GENERAL TECHNICAL FIELD

The present invention relates to a method for intentionally mistuning a bladed wheel of a turbomachine.

PRIOR ART

From upstream to downstream, in the direction of flow of gases, a turbomachine generally comprises a fan, one or more compressor stages, for example a low-pressure compressor and a high-pressure compressor, a combustion chamber, one or more turbine stages, for example a high-pressure turbine and a low-pressure turbine, and a gas exhaust nozzle.

Each compressor or turbine stage is formed by a stationary vane or stator and a rotating vane or rotor around the main axis of the turbomachine.

Each rotor conventionally comprises a disc extending around the main axis of the turbomachine and comprising an annular platform, as well as a plurality of blades distributed uniformly around the main axis of the turbomachine and extending radially relative to this axis from an outer surface of the platform of the disc. There are also "bladed wheels".

The bladed wheels form the object of multiple vibratory phenomena whereof the origins can be aerodynamic and/or mechanical.

The particular focus here is floating, which is a vibratory phenomenon of aerodynamic origin. Floating is linked to the strong interaction between the blades and the fluid passing through them. In fact, when the turbomachine is operating, when fluid is passing through them, the blades modify its flow. In return, the effect of modification to the flow of fluid passing through the blades is to the excite them with vibrations. Now, when the blades are excited in the vicinity of one of their natural vibration frequencies, this coupling between the fluid and the blades can become unstable; this is the phenomenon of floating. This phenomenon materializes via oscillations of increasing amplitude of the blades which can lead to cracking or worse to destruction of the bladed wheel.

This phenomenon is therefore highly dangerous and it is vital to prevent the coupling between the fluid and the blades becoming unstable.

To rectify this problem, it is known to "intentionally mistune" the bladed wheels. The intentional mistuning of a bladed wheel consists of exploiting the cyclic symmetry of the bladed wheel, specifically the fact that the bladed wheels are generally composed of a series of geometrically identical sectors, and creating frequential disparity between all the blades of said bladed wheel. In other words, intentional mistuning of a bladed wheel consists of introducing variations between the natural vibration frequencies of the blades of said bladed wheel. Such frequential disparity stabilizes the bladed wheel vis-a-vis the floating by increasing its aeroelastic cushioning.

"Intentional mistuning" is opposed to "unintentional mistuning" which is the result of small geometric variations in bladed wheels, or small variations in the characteristics of the material constituting it, generally due to tolerances in manufacture and assembly, which can lead to small variations in natural vibration frequencies from one blade to another.

Several solutions have already been offered for intentional mistuning of a bladed wheel.

Document FR 2 869 069 describes for example a method for intentionally mistuning a bladed wheel of a turbomachine determined to reduce the vibratory levels of the wheel in forced response, characterized in that as a function of the operating conditions of the wheel inside the turbomachine, it consists of determining an optimum value of standard deviation of mistuning relative to the maximum response in amplitude of planned vibration on the wheel, fixing to said wheel, at least partly, blades of different natural frequencies such that the distribution of frequencies of all the blades has a standard deviation at least equal to said mistuning value. This document further proposes several technological solutions for modifying the natural vibration frequencies from one blade to the other, including the fact of using different materials for the blades or the fact of acting on their geometry, for example by using blades of different lengths.

The method described in this document however needs to be carried out during designing of the bladed wheel. Now, when the turbomachine is operating, the bladed wheels are subject to multiple and complex vibratory phenomena whereof the sources of excitation are variable and often difficult to predict. It can therefore eventuate that a bladed wheel mistuned according to the method described in this document is nevertheless subject to interfering vibratory phenomena which would not have been able to be foreseen, such as floating, when the turbomachine is operating.

Another example is described in document EP 2 463 481. This document describes a bladed wheel in which projections are provided every second blade over the entire circumference of an inner surface of the platform of the disc, in view of intentional mistuning of said bladed wheel.

Another example is described in document US 2015/0198047. This document describes a bladed wheel comprising alternatively blades formed from a first alloy of titanium and blades formed from a second alloy of titanium, the first and second alloys of titanium inducing natural vibration frequencies of a different blade.

Now, these two documents propose intentional systematic mistuning of the bladed wheels. In other words, irrespective of the bladed wheel concerned, it is mistuned in the same way by introducing a variation in natural vibration frequencies every second blade. It can therefore eventuate that a bladed wheel mistuned in this way is nevertheless subject to interfering vibratory phenomena, such as floating, when the turbomachine is operating.

PRESENTATION OF THE INVENTION

The aim of the present invention especially is to eliminate the drawbacks of the techniques of intentional mistuning of the prior art.

It proposes a method for intentionally mistuning a bladed wheel of a turbomachine to adapt mistuning applied to the geometry of said bladed wheel to be mistuned and therefore to interfering vibratory phenomena such as floating, to which said bladed wheel is subject when the turbomachine is operating.

More precisely, the aim of the present invention is a method for intentionally mistuning a bladed wheel of a turbomachine, said bladed wheel comprising a disc extending around a longitudinal axis and N blades distributed uniformly around said longitudinal axis and extending radially relative to this axis from the disc, N being a nonzero natural integer, said method comprising the following steps:

a) selecting a natural vibration mode of the bladed wheel with k nodal diameters, k being a natural integer different to zero and, when N is an even number, different to $$\frac{N}{2},$$

said natural mode being a vibration mode in the operating range of the turbomachine;

b) determining the displacement of the blades over the entire circumference of the bladed wheel for each of the two standing deformation waves of the same frequency which combined generate the rotating mode shape of the bladed wheel in the selected natural vibration mode;

c) from the displacement of the blades thus determined for each of the two standing deformation waves, determining the blades for which a vibration antinode of a first of said standing deformation waves corresponds to a vibration node of the second standing deformation wave;

d) providing a projection or a notch in the disc of the bladed wheel facing each of the blades thus determined, so as to frequentially separate the two standing deformation waves and intentionally mistune the bladed wheel relative to the selected natural vibration mode.

Preferably, the notches are made by counterboring or the projections are made by metallization.

Preferably, the disc comprises an annular platform from which the blades extend radially, the projections or the notches being provided in the platform of the disc.

Preferably, the projections or the notches are provided in the disc so as to extend over an angular amplitude around the longitudinal axis of between 360°/N and 80°.

Another aim of the present invention is a bladed wheel of a turbomachine comprising a disc extending around a longitudinal axis and N blades distributed uniformly around said longitudinal axis and extending radially from the disc, N being a nonzero natural integer, said bladed wheel comprising also a plurality of projections or notches provided in the disc facing each of the blades determined according to steps a) to c) of the method for intentionally mistuning a bladed wheel of a turbomachine such as previously described.

The mistuning undertaken in this way is different structurally to systematic mistuning.

In particular, the method proposed is of particular interest in the case of mistuning other than one blade in two.

Preferably, the notches are made by counterboring or the projections are made by metallization.

Preferably, the disc comprises an annular platform from which the blades extend radially, the projections or the notches being provided in said platform of the disc.

Preferably, the projections or the notches are provided in the disc so as to extend over an angular amplitude around the longitudinal axis of between 360°/N and 80°.

PRESENTATION OF THE FIGURES

Figure 2A:
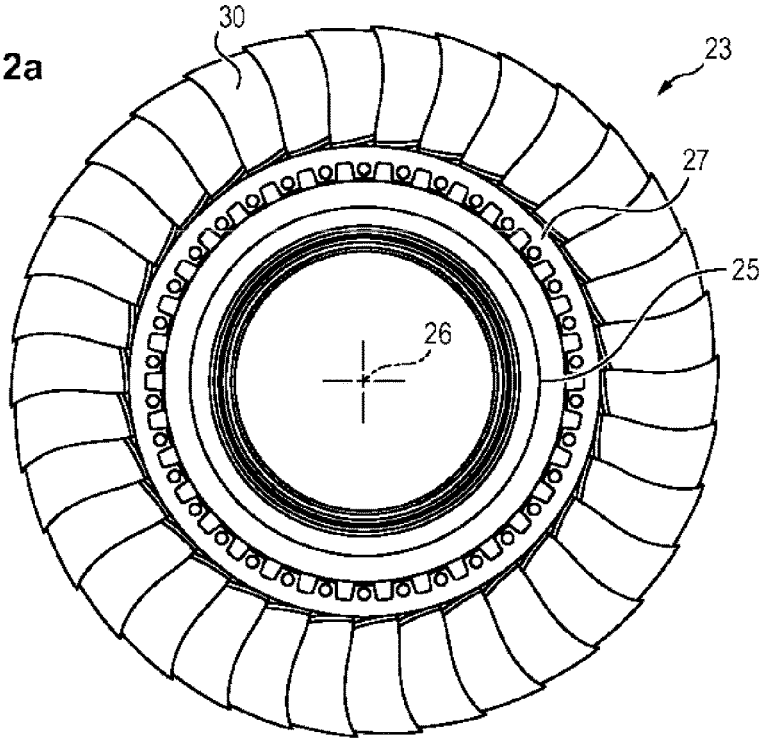
Figure 2B:
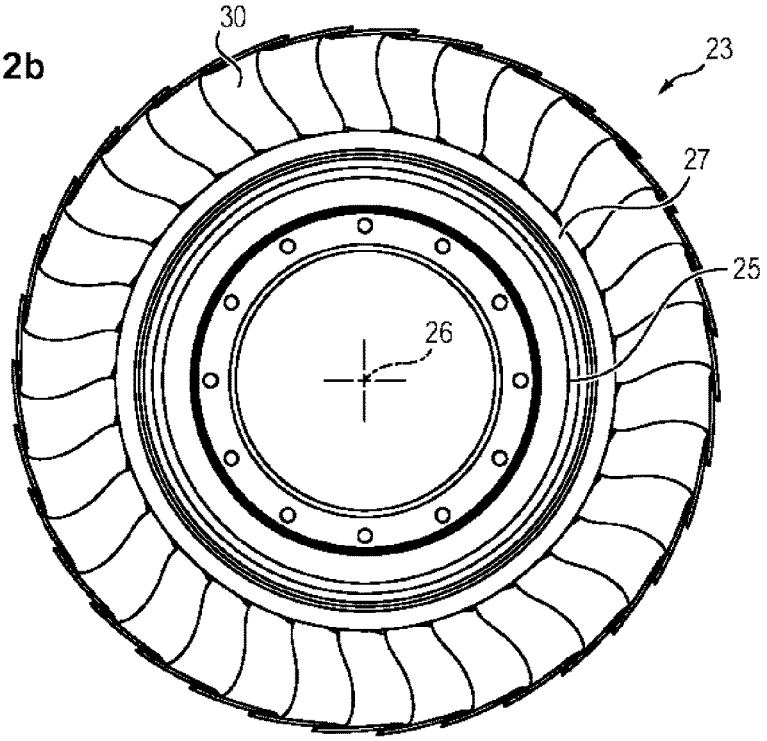
Figure 3A:
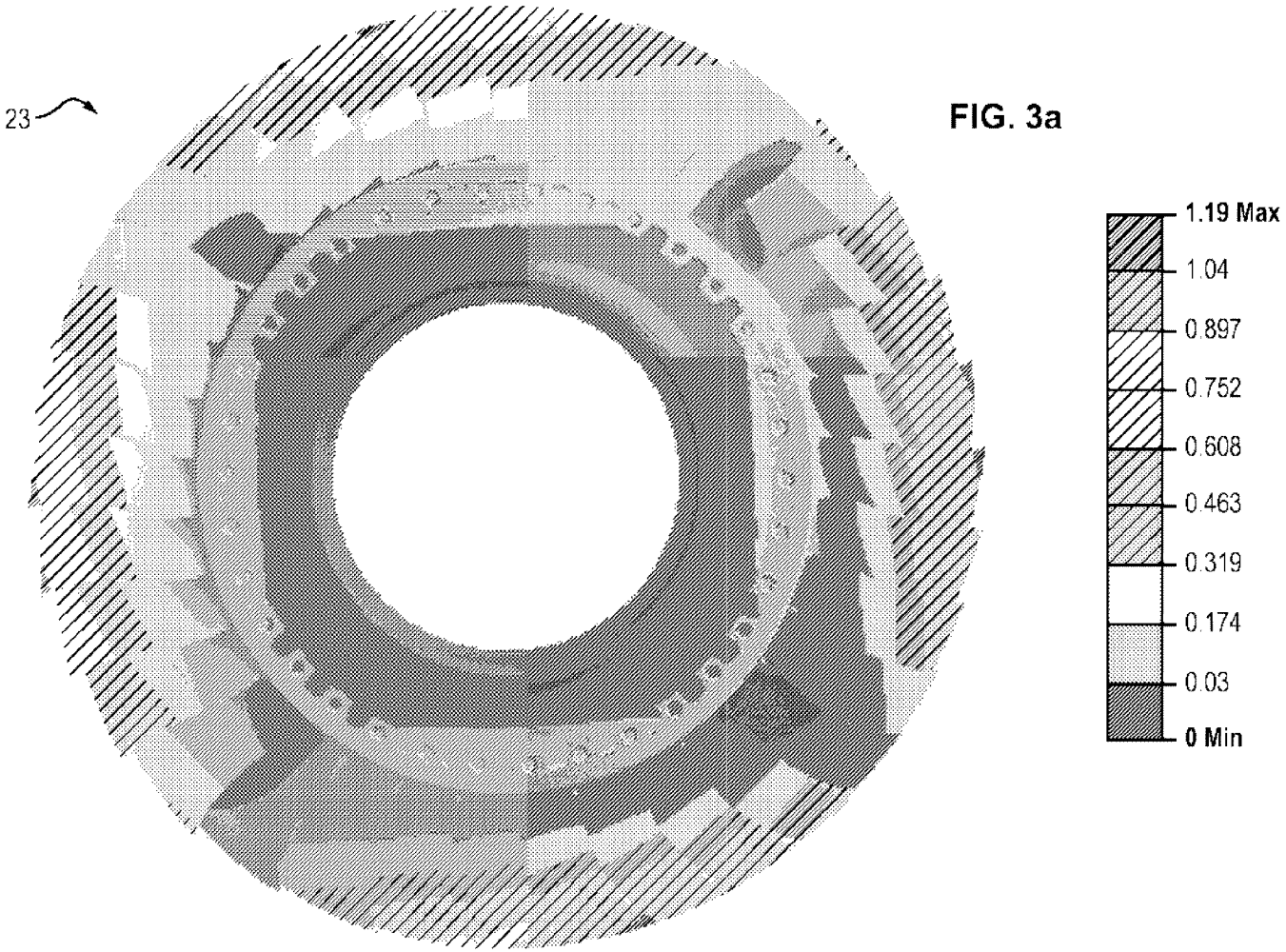

Other characteristics, aims and advantages of the present invention will emerge from the following detailed description and relative to the given appended drawings by way of no-limiting examples and in which:

FIG. 1 is a schematic view of a bypass turbomachine;

FIGS. 2*a* and 2*b* are respectively an upstream and downstream view, relative to the direction of flow of gases, of a bladed wheel prior to implementation of a method for intentionally mistuning a bladed wheel of a turbomachine according to an embodiment of the invention;

FIG. 3*a* shows an upstream view, relative to the direction of flow of gases, of the rotating modal deformation of the first bending mode having two nodal diameters of the bladed wheel illustrated in FIGS. 2*a* and 2*b;*

Figure 3B:
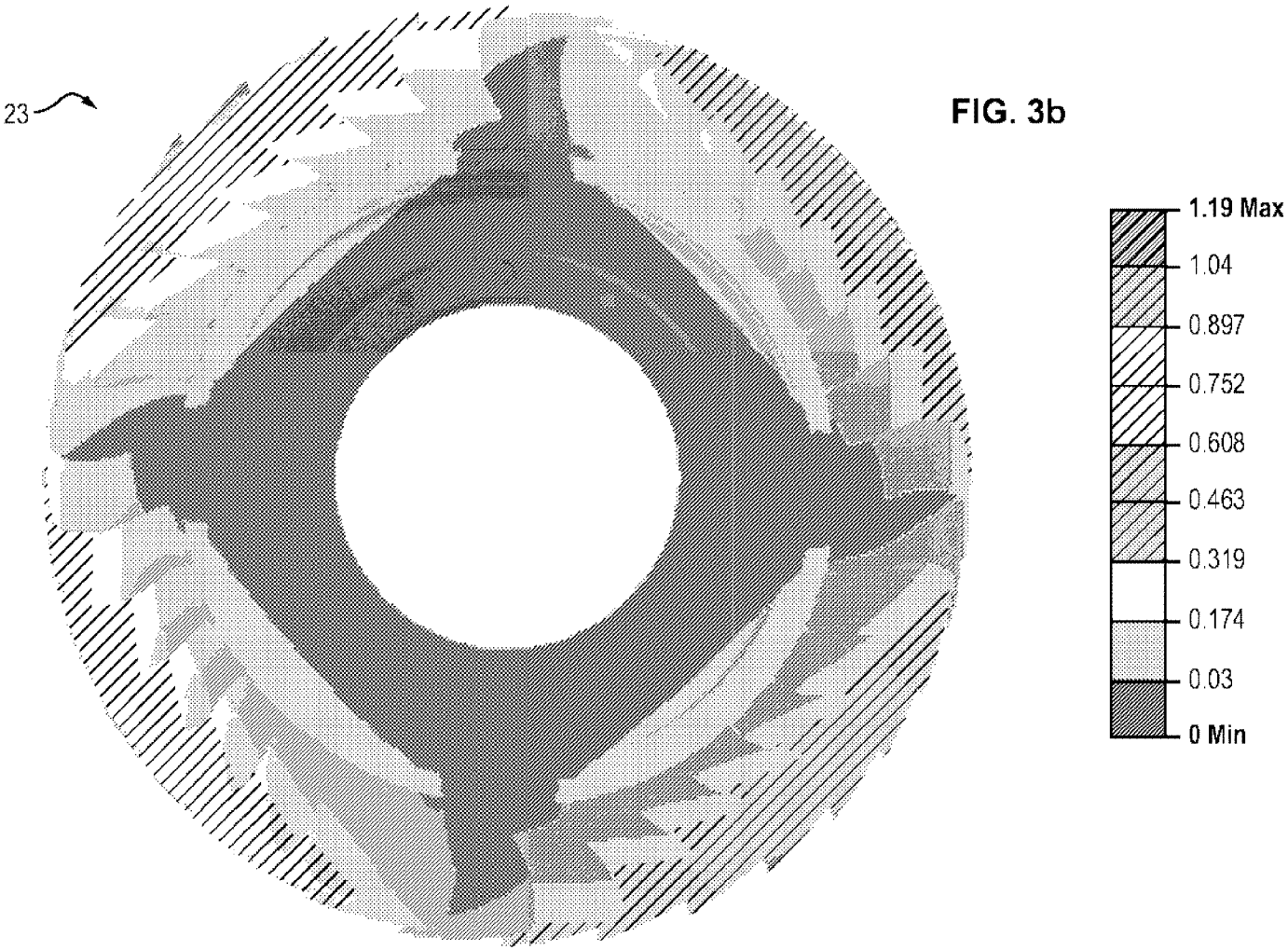

FIG. 3*b* shows a downstream view, relative to the direction of flow of gases, of the mode shape corresponding to a first of the two standing deformation waves which combined generate the rotating mode shape of the bladed wheel illustrated in FIG. 3*a;*

Figure 3C:
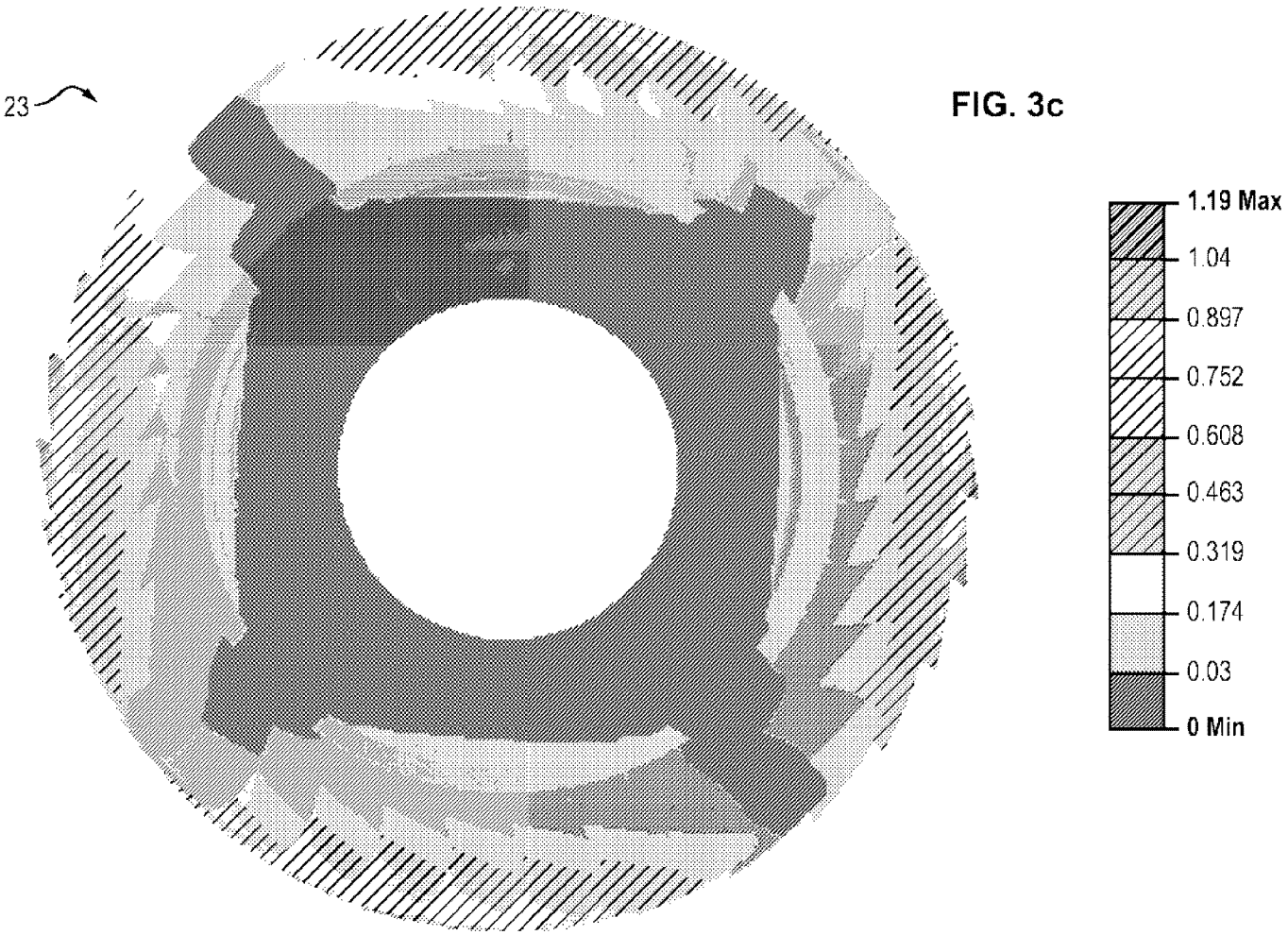

FIG. 3*c* shows a downstream view, relative to the direction of flow of gases, of the mode shape corresponding to a second of the two standing deformation waves which combined generate the rotating mode shape of the bladed wheel illustrated in FIG. 3*a;*

Figure 3D:
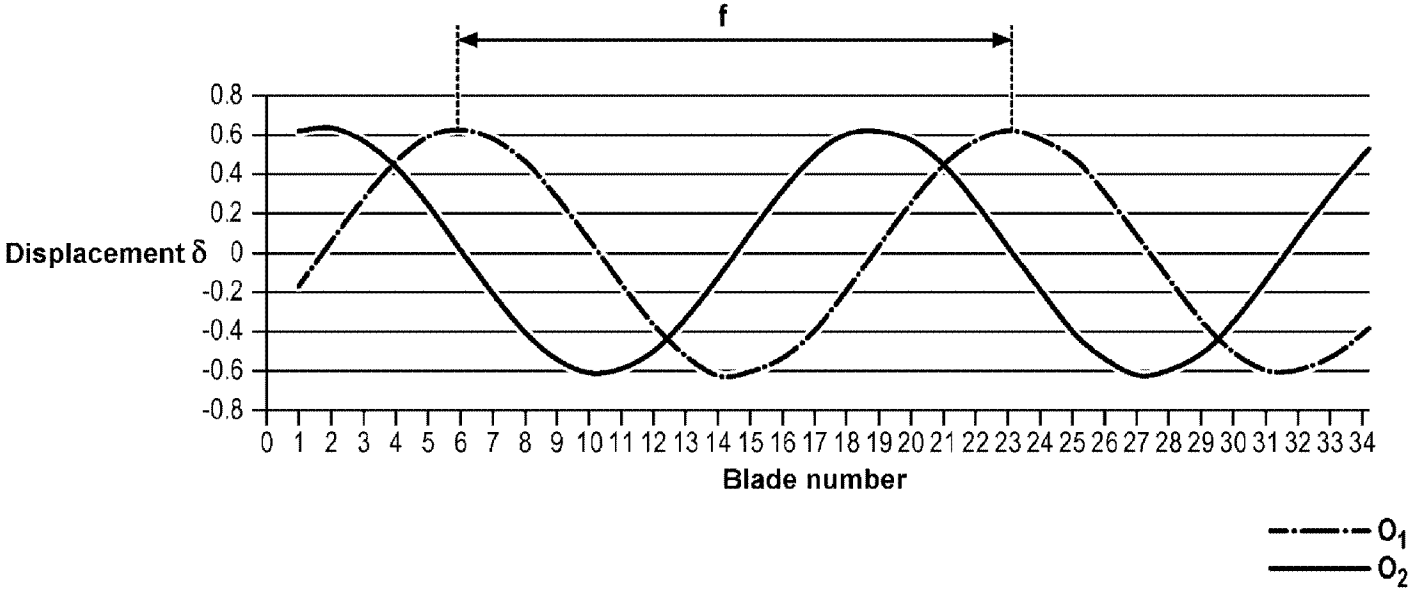
Figure 4:
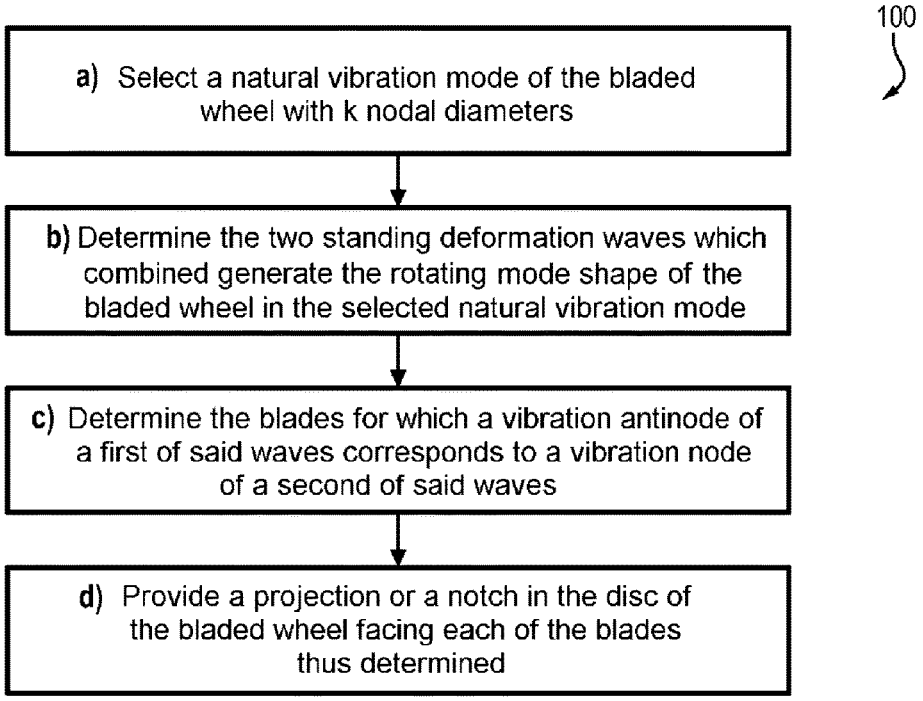
Figure 5A:
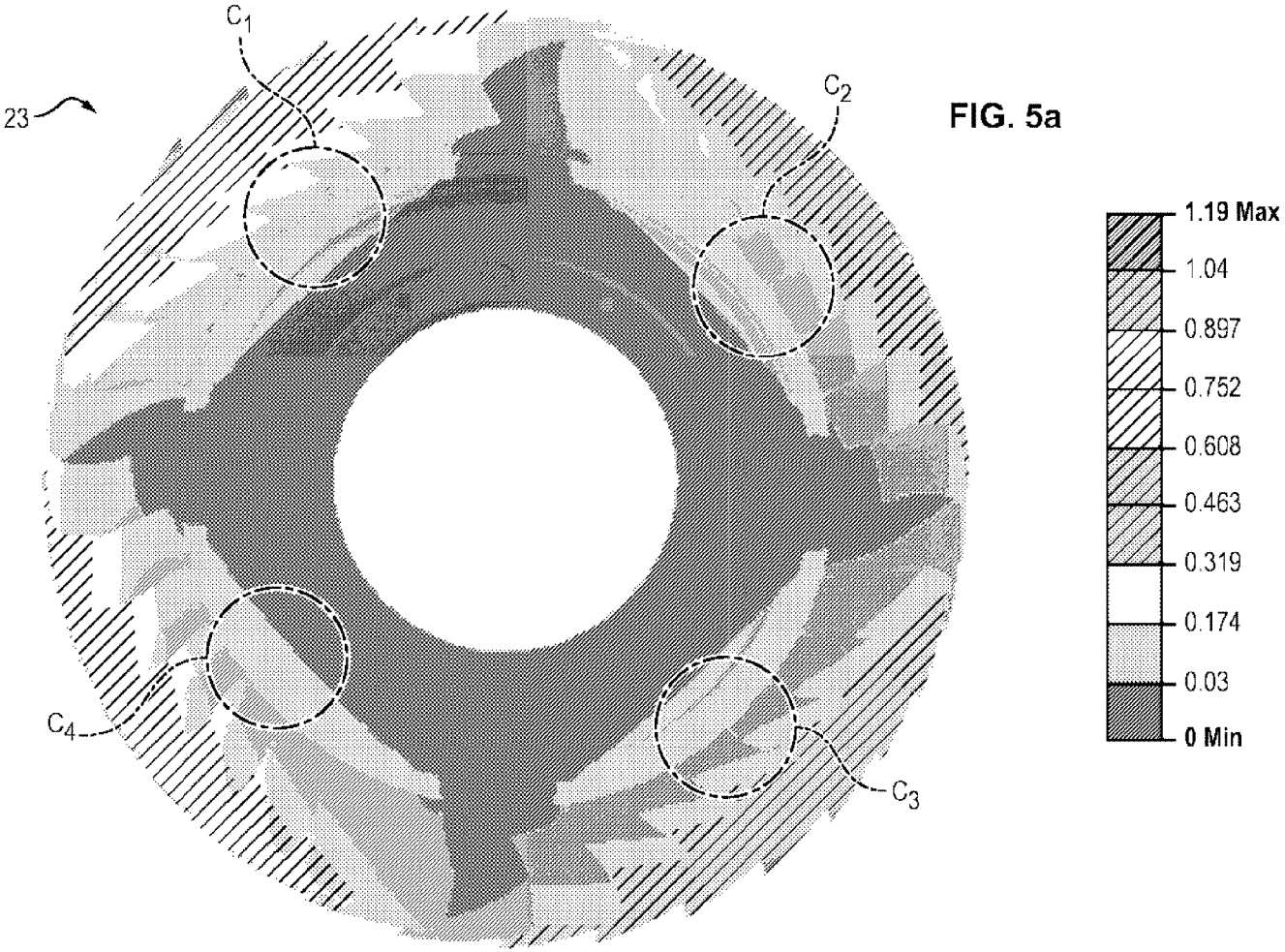
Figure 5B:
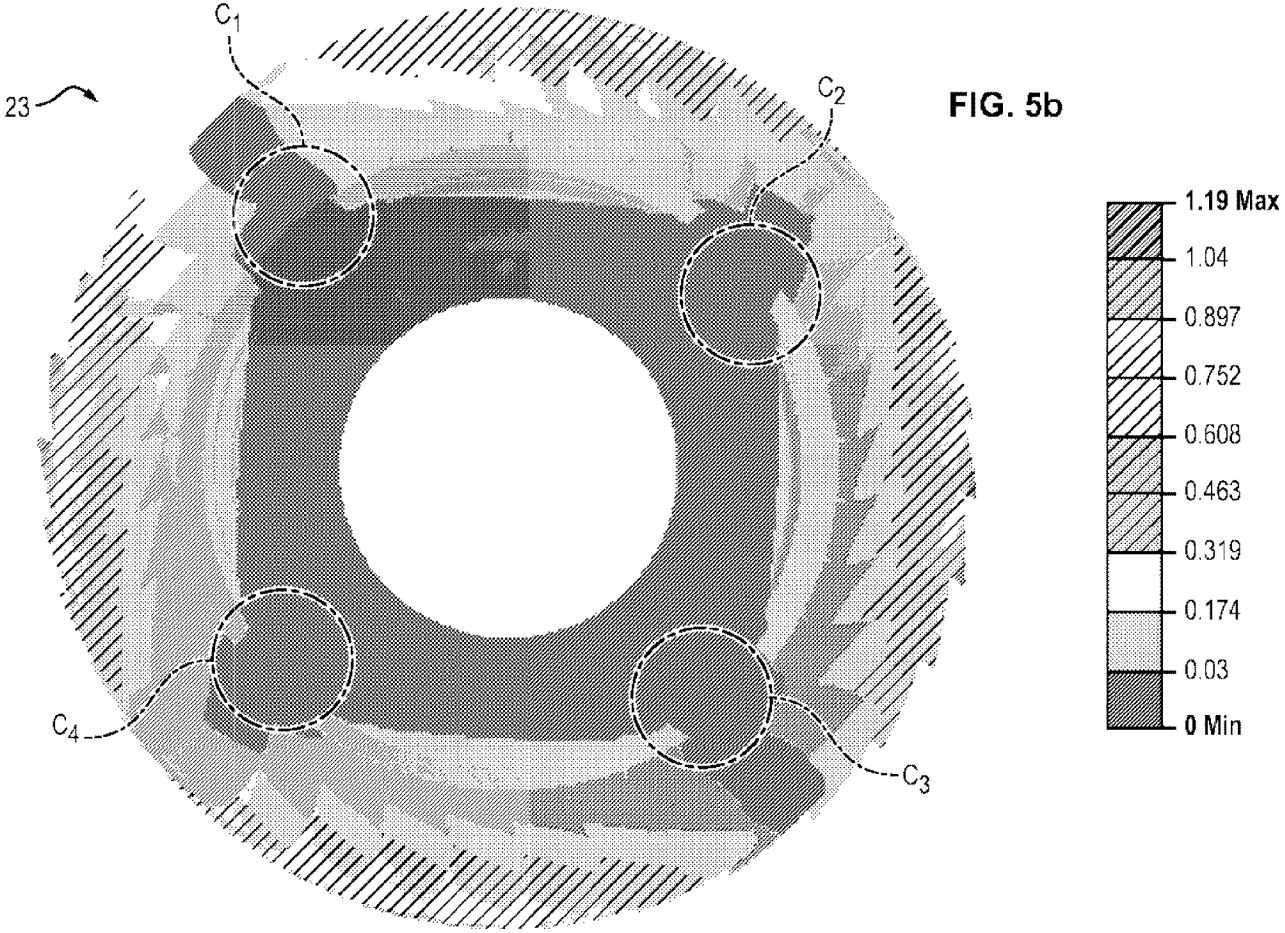
Figure 5C:
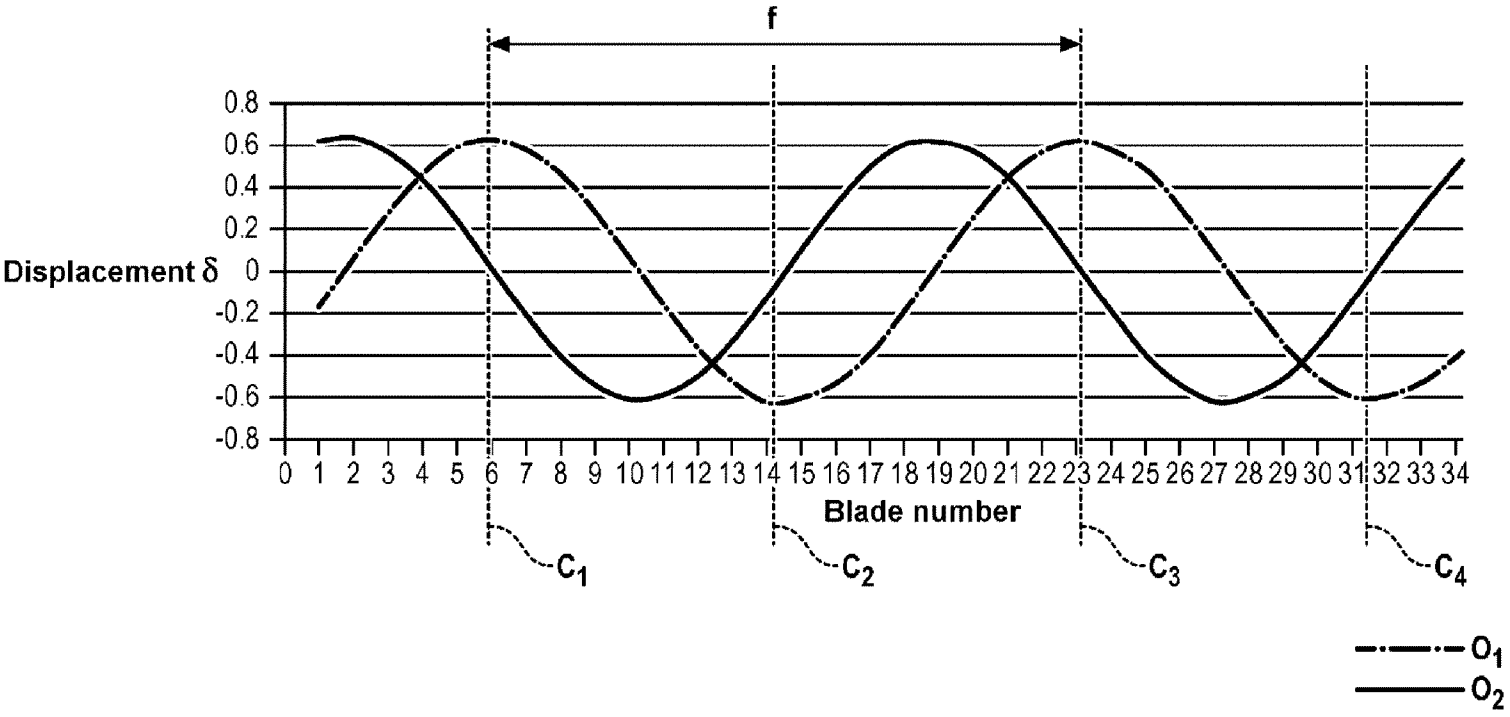
Figure 6A:
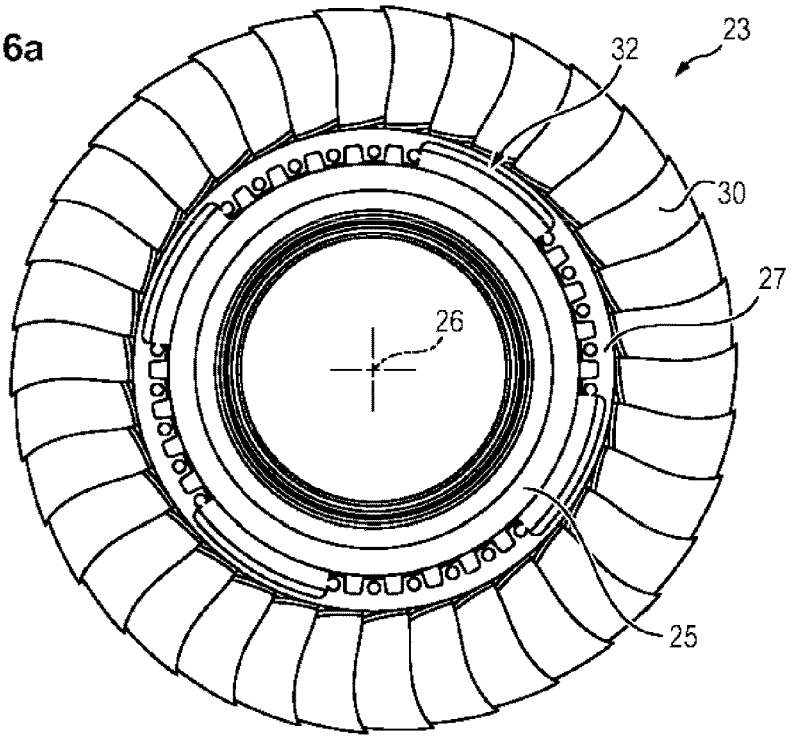
Figure 6B:
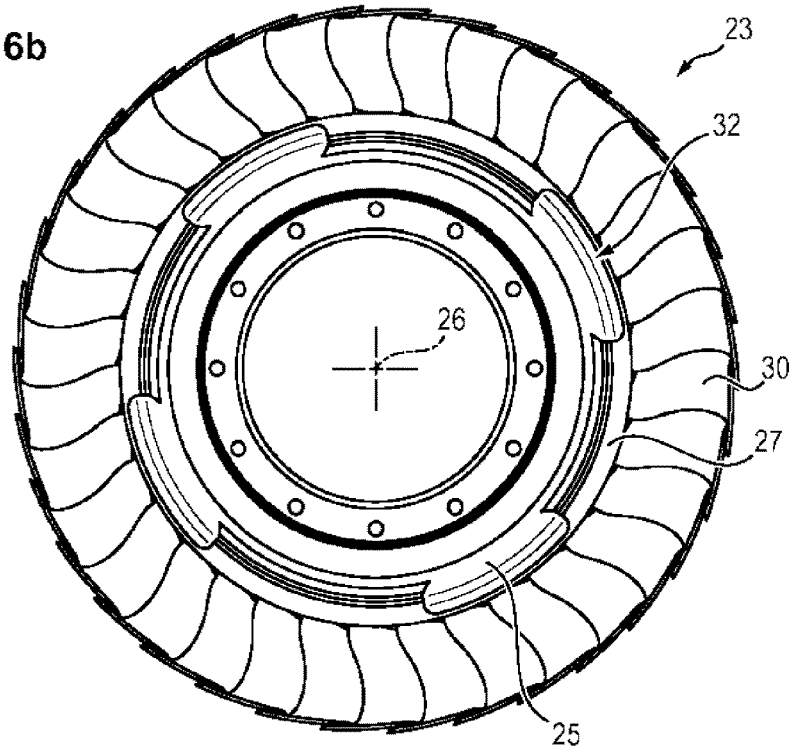
Figure 7A:
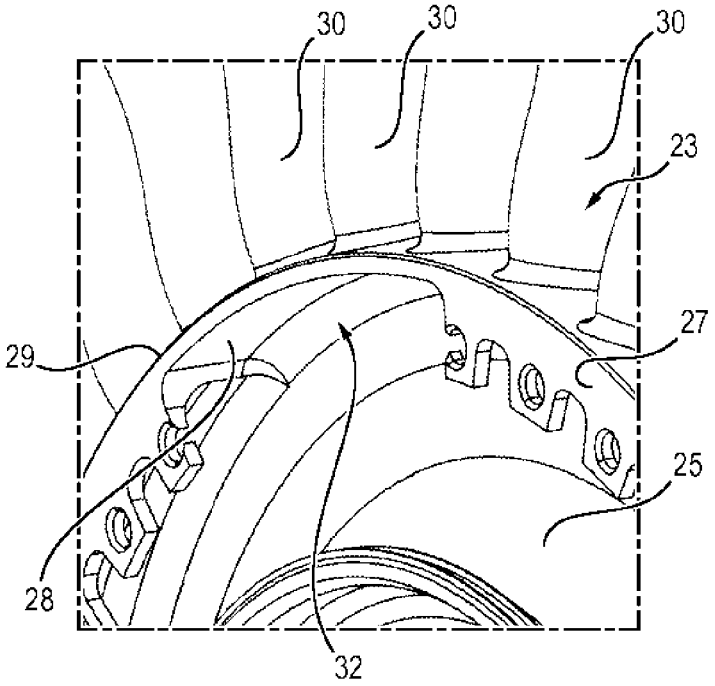
Figure 7B:
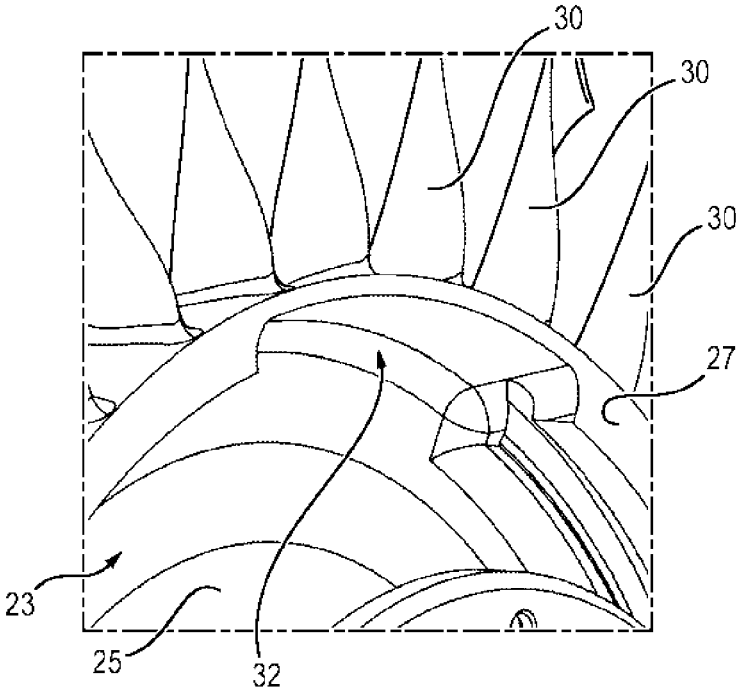
Figure 7C:
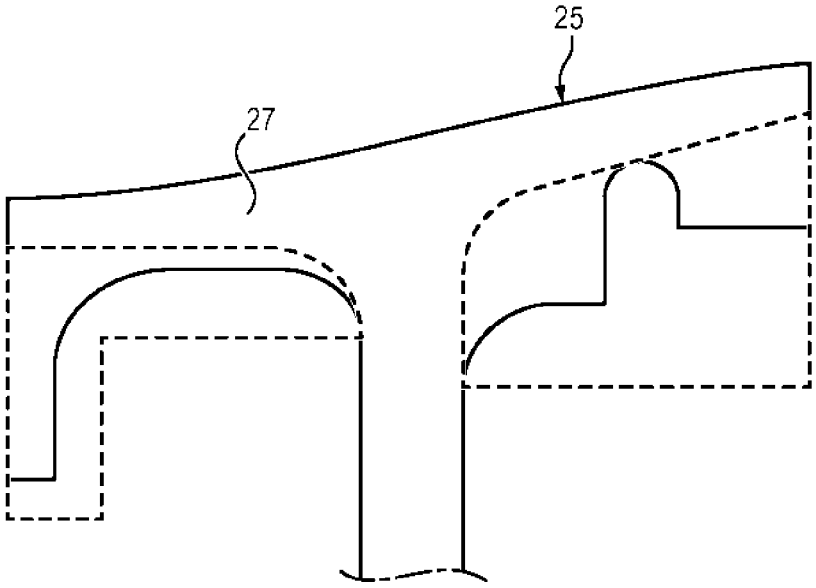
Figure 8A:
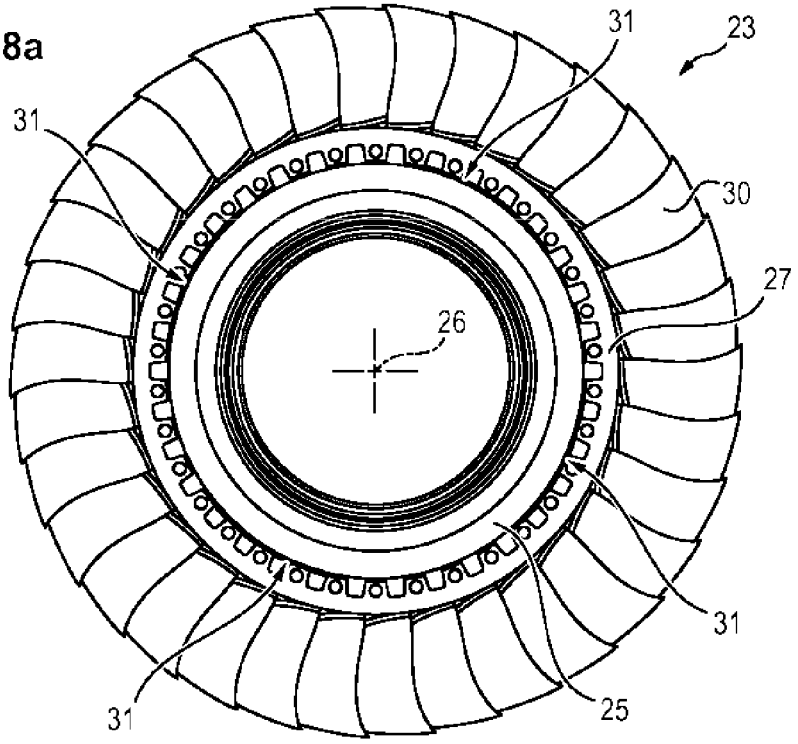
Figure 8B:
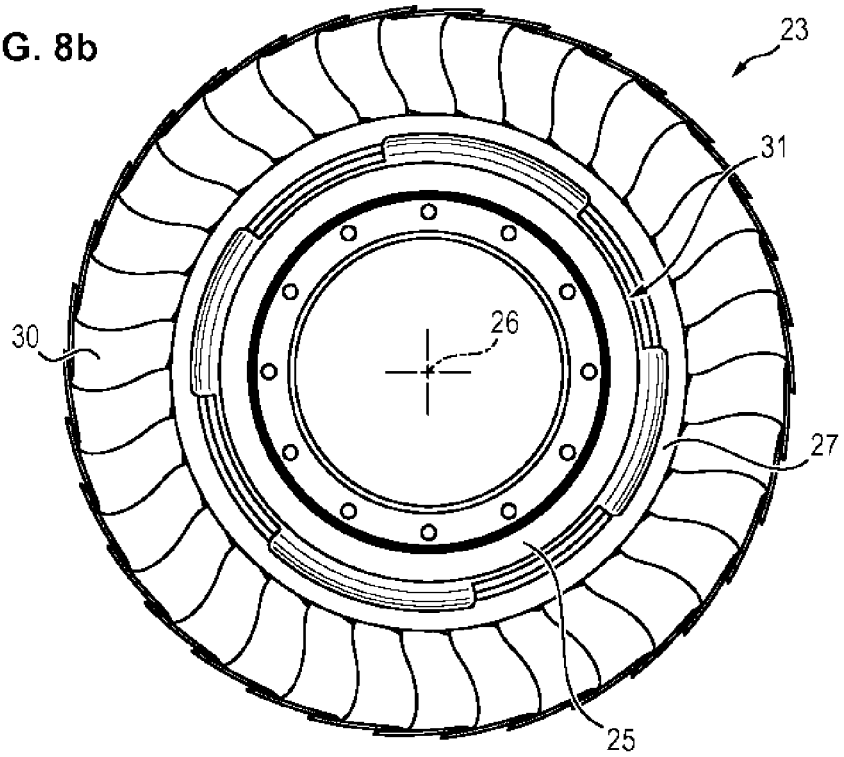
Figure 9A:
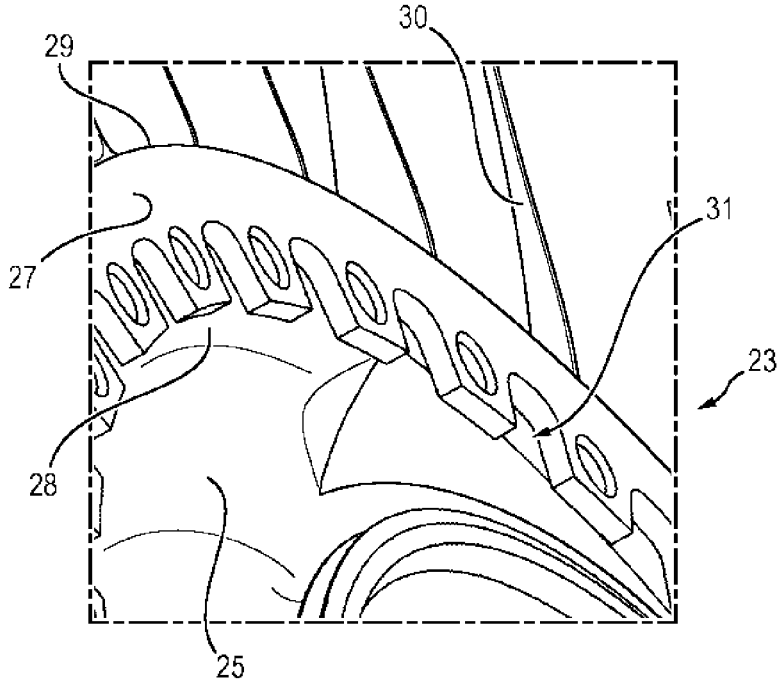
Figure 9B:
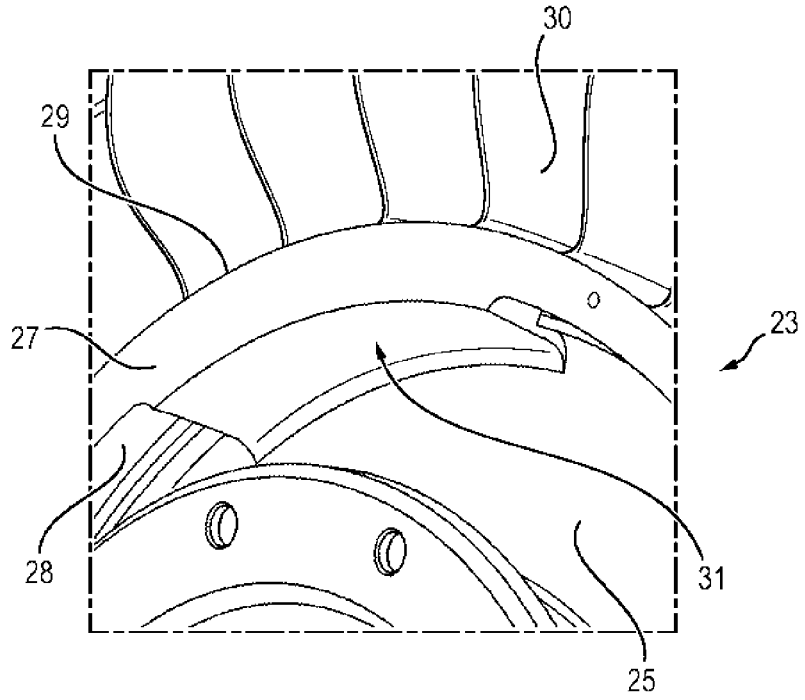

FIG. 3*d* shows a graphic representing the first and second standing deformation waves around the bladed wheel;

FIG. 4 shows the method for intentionally mistuning the bladed wheel, according to an embodiment of the invention;

FIG. 5*a* corresponds to the FIG. 3*b* on which the vibration antinodes of the first standing deformation wave coinciding with the vibration nodes of the second standing deformation wave are revealed;

FIG. 5*b* corresponds to the FIG. 3*c* on which the vibration nodes of the second standing deformation wave coinciding with the vibration antinodes of the first standing deformation wave are revealed;

FIG. 5*c* corresponds to the FIG. 3*d* on which the coincidences between the vibration antinodes of the first standing deformation wave and the vibration nodes of the second standing deformation wave;

FIGS. 6*a* and 6*b* show respectively an upstream and downstream view, relative to the direction of flow of gases, of the bladed wheel illustrated in FIGS. 2*a* and 2*b* after implementation of the method for intentionally mistuning a bladed wheel of a turbomachine according to a first embodiment of the invention;

FIGS. 7*a* and 7*b* show respectively a detailed upstream and downstream view, relative to the direction of flow of gases, of notches provided in the bladed wheel after implementation of the method for intentionally mistuning a bladed wheel of a turbomachine according to the first embodiment of the invention;

FIG. 7*c* shows a partial view, in longitudinal section, of the bladed wheel after implementation of the method for intentionally mistuning a bladed wheel of a turbomachine according to the first embodiment of the invention;

FIGS. 8*a* and 8*b* show respectively an upstream and downstream view, relative to the direction of flow of gases, of the bladed wheel illustrated in FIGS. 2*a* and 2*b* after implementation of the method for intentionally mistuning a bladed wheel of a turbomachine according to a second embodiment of the invention;

FIGS. 9*a* and 9*b* show respectively a detailed upstream and downstream view, relative to the direction of flow of gases, of notches provided in the bladed wheel after implementation of the method for intentionally mistuning a bladed wheel of a turbomachine according to the second embodiment of the invention.

DETAILED DESCRIPTION

As a preliminary issue, "vibration nodes" are called the points of a mechanical system which have zero displacement for a given vibration mode. These points are therefore not in motion. "Vibration antinodes" are called the points of a mechanical system which have maximum displacement for a given vibration mode. These points are therefore of maximum amplitude movement.

FIG. 1 illustrates a bypass turbomachine 10. The turbomachine 10 extends along a main axis 11 and comprises an air shaft 12 via which a gas flow enters the turbomachine 10 and in which the gas flow passes through a fan 13. Downstream of the fan 13, the gas flow is separated into a primary gas flow flowing into a primary airstream 14 and a secondary gas flow flowing in a secondary airstream 15.

In the primary airstream 14, the primary flow passes through from upstream to downstream a low-pressure compressor 16, a high-pressure compressor 17, a combustion chamber 18, a high-pressure turbine 19, a low-pressure turbine 20, and a gas discharge casing to which an exhaust nozzle 22 is connected. In the secondary airstream 15, the secondary flow passes through a stationary vane or fan rectifier 24, then mixes with the primary flow at the exhaust nozzle 22.

Each compressor 16, 17 of the turbomachine 10 comprises several stages, each stage being formed by a stationary vane or stator and a rotary vane or rotor 23 around the main axis 11 of the turbomachine 10. The rotary vane or rotor 23 is also called "bladed wheel".

FIGS. 2*a* and 2*b* show respectively an upstream and downstream view, relative to the direction of flow of gases, of a bladed wheel 23 prior to implementation of a method 100 for intentionally mistuning a bladed wheel of a turbomachine according to an embodiment of the invention.

The bladed wheel 23 comprises a disc 25 extending around a longitudinal axis 26 which, when the bladed wheel 23 is mounted in the turbomachine 10, is combined with the main axis 11 of said turbomachine 10. The bladed wheel 23 further comprises an annular platform 27 arranged at the periphery of the disc 25. The platform 27 has an inner surface 28 facing the longitudinal axis 26 and an outer surface 29 which is opposite it. The platform 27 extends on either side of the disc 25 in the direction of the longitudinal axis 26.

The bladed wheel 23 further comprises a plurality of blades 30 distributed uniformly around the longitudinal axis 26 and extending radially relative to this axis 26 from the outer surface 29 of the platform 27. The bladed wheel 23 comprises N blades 30, N being a nonzero natural integer. The blades 30 can be one piece with the disc 25 or be attached to the disc 25 by means well known to the skilled person. In the example illustrated in FIGS. 2*a* and 2*b*, the bladed wheel 23 comprises thirty four blades 30 and are in a single piece with the disc 25.

Each blade 30 comprises a leading edge which is located axially upstream in the direction of flow of gases relative to said blade 30, and a trailing edge which is located axially downstream in the direction of flow of gases relative to said blade 30.

In general, bladed wheels have a cyclic symmetry. In other words, bladed wheels are composed of a series of geometrically identical sectors repeated circularly. For example, the bladed wheel 23 comprises N identical sectors, one sector being associated with each of the blades 30.

To achieve modal analysis of the bladed wheel, the aim is to resolve the eigenvalue problem: $(K-\omega^2M)X=0$, with K corresponding to the stiffness matrix of the bladed wheel, M corresponding to the mass matrix of the bladed wheel, X corresponding to the displacement vector of the bladed wheel and ω corresponding to the natural pulses of the bladed wheel.

Now, the cyclic symmetry of the bladed wheel performs modal analysis of the whole bladed wheel by taking on a single sector. For this, the viewpoint is the Fourier space and the eigenvalue problem mentioned hereinabove can be reformulated as follows: $(\tilde{K}_k-\omega^2\tilde{M}_k)\tilde{X}_k=0$, with k corresponding to the Fourier orders, $\tilde{K}_k$ corresponding to the stiffness matrix of the sector in order k, $\tilde{M}_k$ corresponding to the mass matrix of the sector in order k, $\tilde{X}_k$ corresponding to the displacement vector of the sector in order k and ω corresponding to the natural pulses of the sector. The problem with eigenvalues reformulated in this way is resolved for each Fourier order k. Fourier orders $k\in[0; K]$ are generally considered, with:

$$K=\begin{cases}\dfrac{N}{2} & \text{if } N \text{ is even,}\\[2mm] \dfrac{N-1}{2} & \text{if } N \text{ is odd.}\end{cases}$$

The eigenvalues obtained for each Fourier order k correspond to eigenvalues of the whole bladed wheel.

The solutions obtained for k=0 and, when N is even, $$k=\frac{N}{2}$$

correspond respectively to natural vibration modes where all the sectors are deformed in phase and at natural vibration modes where the adjacent sectors are deformed in phase opposition. The mode shapes of the bladed wheel for all the natural vibration modes associated with each of these two Fourier orders correspond to a standing deformation wave.

For the other Fourier orders k, the solutions are double and each natural pulse $\omega_k$, is associated with two natural orthogonal vectors which form a base for the natural vibration modes associated with these Fourier orders, such that any linear combination of these vectors is also a natural vector. The mode shapes of the bladed wheel for all the natural vibration modes associated with each of these Fourier orders corresponds to a rotary deformation wave which is the linear combination of two standing deformation waves of the same frequency. The two standing deformation waves are offset by a quarter period.

Apart from the mode shapes of the natural vibration modes corresponding to the Fourier order k=0, the mode shapes of a bladed wheel have nodal lines which extend radially relative to the longitudinal axis of the bladed wheel. These nodal lines are commonly called "nodal diameters" and their number corresponds to the Fourier order k.

By way of illustration, FIGS. 3*a* to 3*d* show respectively:

- the mode shape of the first bending mode having two nodal diameters of the bladed wheel 23, this mode shape being rotating;
- the mode shape corresponding to a first $O_1$ of the two standing deformation waves $O_1$ and $O_2$ which combined generate the mode shape of the bladed wheel 23 illustrated in FIG. 3*a;*
- the mode shape corresponding to a second $O_2$ of the two standing deformation waves $O_1$ and $O_2$ which combined generate the mode shape of the bladed wheel 23 illustrated in FIG. 3*a;*
- a graphic representing the first and second standing deformation waves $O_1$ and $O_2$ around the bladed wheel 23; this graphic shows the displacement δ of the blades 30 over the entire circumference of the bladed wheel 23, the blades 30 being numbered from 1 to N in order of appearance on the circumference of the bladed wheel 23, corresponding to each of the standing deformation waves $O_1$ and $O_2$; on the graphic, the displacement δ of the blades 30 corresponds to displacement of the blades 30 at the tip of their leading edge and it is standardized relative to the maximum displacement of said blades 30; it is clear here that the two standing deformation waves $O_1$ and $O_2$ are offset by a quarter period.

For more information on modal analysis of bladed wheels, reference could be made for example to the following documents:

Nicolas Salvat, Alain Batailly, Mathias Legrand. Caractéristiques modales des mouvements d'arbre pour des structures à symétrie cyclique. "*Modal characteristics of shaft movements for cyclic symmetry structures*". 2013. <hal-00881272v2>, Bartholome Segui Vasquez. Modélisation dynamique des systèmes disques aubes multi-étages: Effets des incertitudes. "*Dynamic modelling of multi-stages blade disc systems: Uncertainty effects*". Other. INSA de Lyon, 2013. French. <NNT: 2013ISAL0057>, Denis Laxalde. Etude d'amortisseurs non-linéaires appliqués aux roues aubagées et aux systèmes multi-étages. "*Study on non-linear shock absorbers applied to bladed wheels and multi-stage systems*". Mechanics. Ecole Centrale de Lyon, 2007. French. <tel-00344168>;

Marion Gruin. Dynamique non-linéaire d'une roue de turbine Basse Pression soumise à des excitations structurales d'un turboréacteur. "*Non-linear dynamics of a low-pressure bladed wheel subject to structural excitations of a turbojet*". Other. Ecole Centrale de Lyon, 2012. French. <NNT: 2012ECDL0003>. <tel-00750011>.

FIG. 4 shows the method 100 for intentionally mistuning the bladed wheel 23, according to an embodiment of the invention. The method 100 comprises the following steps:

a) selecting a natural vibration mode of the bladed wheel 23 with k nodal diameters, k being a natural integer different to zero and, when N is an even number, different to $$\frac{N}{2};$$

b) determining the displacement δ of the blades 30 over the entire circumference of the bladed wheel 23 for each of the two standing deformation waves $O_1$ and $O_2$ of the same frequency f which combined generate the rotating mode shape of the bladed wheel 23 in the selected natural vibration mode;

c) from the displacement δ of the blades 30 thus determined for each of the two standing deformation waves $O_1$ and $O_2$, determining the blades 30 for which a vibration antinode of a first of said standing deformation waves $O_1$, $O_2$ corresponds to a vibration node of the second standing deformation wave $O_2$, $O_1$;

d) providing a projection 31 or a notch 32 in the disc 25 of the bladed wheel 23 facing each of the blades 30 thus determined, so as to frequentially separate the two standing deformation waves $O_1$ and $O_2$ and intentionally mistune the bladed wheel 23 relative to the selected natural vibration mode.

The method 100 modifies one of the two standing deformation waves $O_1$ and $O_2$ without impacting the other of said standing deformation waves $O_1$ and $O_2$, ensuring frequential separation of said two standing deformation waves $O_1$ and $O_2$ and therefore of the blades 30 arranged facing the notches 31 relative to the other blades 30. The method 100 benefits from the strong dynamic coupling between the blades 30 and the disc 25 to induce frequential disparity between the blades 30 by modifying the geometry of the disc 25.

The method 100 is particularly advantageous as it intentionally mistunes the bladed wheel 23 out of design process of said bladed wheel 23 and without applying systematic mistuning which would not necessarily be adapted to said bladed wheel 23. The bladed wheel 23 can in effect be mistuned intentionally once the bladed wheel 23 is designed and produced to the extent where not the blades 30 but the disc 25 is modified directly. Also, not modifying as the geometry or the material of the blades 30 avoids impacting their aerodynamism.

Step a) is for example conducted following wind tunnel testing of the turbomachine 10 and therefore of the bladed wheel 23, having revealed interfering vibratory phenomena, such as floating at a natural vibration mode of the bladed wheel 23. These interfering vibratory phenomena can for example appear in the form of cracks at the root of the blades 30. These cracks can then be connected to a particular vibratory phenomenon, for example floating, and the natural vibration mode(s) for which this vibratory phenomenon appears can then be determined.

Step b) is for example conducted via digital simulation by means of adapted software, such as the digital simulation software proposed by ANSYS Inc which implements the finite element method. The displacement δ of the blades 30 over the entire circumference of the bladed wheel 23 is for example determined at the tip of the leading edge of the blades 30. "Tip of the leading edge" means the point of the leading edge of the blades 30 which is farthest from the longitudinal axis 26.

FIGS. 5*a* to 5*c* illustrate step c) when the natural mode selected at step a) is the first bending mode having two nodal diameters. These figures show that the vibration antinodes of the first standing deformation wave $O_1$ coincide with the vibration nodes of the second standing deformation wave $O_2$ at the four blades. These are blades here numbered 6, 14, 23, and 31. These coincidences are referenced $C_1$ to $C_4$ in FIGS. 5*a* to 5*c*.

In step c), each vibration antinode of the first standing deformation wave $O_1$ can also coincide with a vibration node of the second standing deformation wave $O_2$ at several adjacent blades 30. In this case, a projection 31 or notch 32 can be provided in the disc 25, facing each series of adjacent blades 30, over an angular amplitude around the longitudinal axis 26 at least equal to the number of blades 30 of each series multiplied by 360°/N.

FIGS. 6*a* and 6*b* show the bladed wheel 23 after implementation of the method 100, and FIGS. 7*a* and 7*b* show the notches 32 provided in the disc 25 in step d) in more detail.

The notches 32 are provided in the platform 27 of the disc 25. The notches 32 are provided in the disc 25 as closely as possible to the blades 30, effectively heightening the effect of modification geometric of the disc 25 on the frequency of the blades 30.

The notches 32 are preferably positioned on the platform 27 symmetrically relative to said disc 25 to ensure the dynamic equilibrium of the bladed wheel 23.

The notches 32 extend preferably over an angular amplitude around the longitudinal axis 26 between 360°/N and 80°. In the example illustrated in FIGS. 6*a* and 6*b*, the notches 32 extend over an angular amplitude substantially of 40° around the longitudinal axis 26. "Substantially of 40°"

means the fact that the notches 32 extend over an angular amplitude of 40° around the longitudinal axis 26 to within 5°.

The notches 32 are for example made by counterboring. The counterboring applied to the disc 25, more precisely to the platform 27 of the disc 25, is illustrated in dotted lines in FIG. 7*c*.

In the example illustrated in FIGS. 6*a* and 6*b*, the notches 32 provided in the disc 25 of the bladed wheel 23 correspond for example to a removal of material from the bladed wheel 23 of about 5.5% of the mass of the bladed wheel 23 prior to implementation of the method 100, and create frequential separation substantially of 4.1% in the first bending mode of two nodal diameters between the blades 30 located facing the notches 32 and the other blades 30.

FIGS. 8*a* and 8*b* show the bladed wheel 23 after implementation of the method 100, and the FIGS. 9*a* and 9*b* show the projections 31 provided in the disc 25 at step d) in more detail.

The projections 31 are provided in the platform 27 of the disc 25. The projections 31 are provided in the disc 25 as closely as possible to the blades 30, effectively heightening the effect of geometric modification of the disc 25 on the frequency of the blades 30.

The projections 31 are preferably positioned on the platform 27 symmetrically relative to said disc 25 to ensure dynamic equilibrium of the bladed wheel 23.

The projections 31 extend preferably radially from the inner surface 28 of the platform 27 of the disc 25. In other words, the projections 31 extend preferably radially from the platform 27 to the longitudinal axis 26.

In the example illustrated in FIGS. 9*a* and 9*b*, the projections 31 extend radially from the platform 27 and along the longitudinal axis 26 from the disc 25.

In the example illustrated in FIGS. 9*a* and 9*b*, at its end arranged upstream relative to the direction of flow of gases, the platform 27 comprises a flange extending radially towards the longitudinal axis 26. The flange is provided with through openings arranged parallel to the longitudinal axis 26 and configured to receive weights, for example bolts, so that they can rebalance the bladed wheel 23, if needed. In this case, the projections 31 are preferably arranged at a distance from the flange so as to free up a space between the projections 31 and the flange and accordingly not prevent the insertion of weights into the openings.

The projections 31 extend preferably over an angular amplitude around the longitudinal axis 26 between 360°/N and 80°. In the example illustrated in FIGS. 8*a* and 8*b*, the projections 31 extend over an angular amplitude substantially of 40° around the longitudinal axis 26. "Substantially of 40°" means the fact that the notches 32 extend over an angular amplitude of 40° around the longitudinal axis 26 to within 5°.

The projections 31 are for example made by metallization of the disc 25, that is, by addition of material to the disc 25. Preferably, the projections 31 are made from material which is the same as that from which the disc 25 is made to preserve the mechanical performance and the service life of the bladed wheel 23. However, the projections 31 can also be made from material different to that from which the disc 25 is manufactured.

It will be clear that with his general knowledge the skilled person will know how much material to remove from or add to the disc 25 relative to the mass of the bladed wheel 23 prior to implementation of the method 100 so as to obtain preferred frequential separation for the selected natural vibration mode between the blades 30 located facing the projections 31 or the notches 32 and that of the other blades 30.

The present invention is described hereinbelow by making reference to a bladed wheel 23 of a compressor 16, 17 of a turbomachine 10. But, the invention applies in the same way to a rotor 32 of a turbine 19, 20 or to a fan 13, to the extent where these bladed wheels can be also confronted by interfering vibratory phenomena, such as floating. As will have been clear, the proposed method is particularly interesting in the case of mistuning other than one blade in two.

The invention claimed is:

1. A method for intentionally mistuning a bladed wheel of a turbomachine, said bladed wheel comprising a disc extending around a longitudinal axis and N blades distributed uniformly around said longitudinal axis and extending radially relative to this axis from the disc, N being a nonzero natural integer, said method comprising the following steps:

a) selecting a natural vibration mode of the bladed wheel with k nodal diameters, k being a natural integer different to zero and, when N is an even number, different to $$\frac{N}{2},$$

said natural mode being a vibration mode in the operating range of the turbomachine;

b) determining a displacement of the blades over an entire circumference of the bladed wheel for each of two standing deformation waves of the same frequency which are combine to generate a rotating mode shape of the bladed wheel in the selected natural vibration mode;

c) from the displacement of the blades thus determined for each of the two standing deformation waves, determining the blades for which a vibration antinode of a first of said standing deformation waves corresponds to a vibration node of the second standing deformation wave;

d) providing a projection or a notch in the disc of the bladed wheel facing each of the blades thus determined, so as to frequentially separate the two standing deformation waves and intentionally mistune the bladed wheel relative to the selected natural vibration mode.

2. The method according to claim 1, wherein the notches are made by counterboring or the projections are made by metallization.

3. The method according to claim 1, wherein the disc comprises an annular platform from which the blades extend radially, the projections or the notches being provided in said platform of the disc.

4. The method according to claim 1, wherein the projections or the notches are provided in the disc so as to extend over an angular amplitude around the longitudinal axis of between 360°/N and 80°.

5. A bladed wheel of a turbomachine comprising a disc extending around a longitudinal axis and N blades distributed uniformly around said longitudinal axis and extending radially from the disc, N being a nonzero natural integer, said bladed wheel being characterized in that it comprises a plurality of projections or notches provided in the disc facing each of the blades determined according to steps a) to c) of the method for intentionally mistuning a bladed wheel of a turbomachine according to claim 1.

6. The bladed wheel according to claim 5, wherein the notches are made by counterboring or the projections are made by metallization.

7. The bladed wheel according to claim 5, wherein the disc comprises an annular platform from which the blades extend radially, the projections or the notches being provided in said platform of the disc.

8. The bladed wheel according to claim 5, wherein the projections or the notches are provided in the disc so as to extend over an angular amplitude around the longitudinal axis of between 360°/N and 80°.

* * * * *